US007363866B2

(12) United States Patent
Gnedenko et al.

(10) Patent No.: US 7,363,866 B2
(45) Date of Patent: Apr. 29, 2008

(54) CONTROL SYSTEM FOR A WASTE PROCESSING APPARATUS

(76) Inventors: Valeri G. Gnedenko, 19 Berzarina Street, Bldg. 1, Apt. 201, Moscow 201 (RU) 123585; Alexander Suris, 25 Cheliabinskaya Street, Bldg. 1, Apt. 84, Moscow (RU) 105568; David Pegaz, 1 E. Mohl Street, Apt. 14, Netanya (IL) 001444

( * ) Notice: Subject to any disclaimer, the term of this patent is extended or adjusted under 35 U.S.C. 154(b) by 568 days.

(21) Appl. No.: 10/507,836

(22) PCT Filed: Mar. 18, 2002

(86) PCT No.: PCT/IL02/00213

§ 371 (c)(1),
(2), (4) Date: Mar. 24, 2005

(87) PCT Pub. No.: WO03/078897

PCT Pub. Date: Sep. 25, 2003

(65) Prior Publication Data

US 2005/0161375 A1 Jul. 28, 2005

(51) Int. Cl.
*F23K 3/00* (2006.01)

(52) U.S. Cl. ..... 110/101 CD; 110/192; 110/242; 110/101 C; 110/118

(58) Field of Classification Search ..... 110/238, 110/185, 186, 242, 116, 118, 101 R, 191, 110/192, 101 CD; 210/104, 120, 134, 175, 210/739, 774, 86, 87
See application file for complete search history.

(56) References Cited

U.S. PATENT DOCUMENTS

| | | | | |
|---|---|---|---|---|
| 3,322,957 | A * | 5/1967 | Scoggin | 250/573 |
| 4,017,269 | A | 4/1977 | Dutz et al. | |
| 4,831,944 | A | 5/1989 | Durand et al. | |
| 5,143,000 | A * | 9/1992 | Camacho | 110/250 |
| 5,314,127 | A | 5/1994 | Coulthard | |
| 5,634,414 | A | 6/1997 | Camacho | |

FOREIGN PATENT DOCUMENTS

| | | |
|---|---|---|
| EP | 1046861 A1 | 10/2000 |
| GB | 641898 | 8/1950 |
| JP | 10085703 | 7/1998 |
| JP | 10238744 | 9/1998 |
| WO | WO 01/92784 A1 | 12/2001 |
| WO | WO 02/29321 A1 | 4/2002 |

* cited by examiner

*Primary Examiner*—Kenneth Rinehart
(74) *Attorney, Agent, or Firm*—Browdy and Neimark

(57) ABSTRACT

A control system for a waste processing apparatus controls entry of a predetermined quantity of waste into the processing chamber via air lock whenever the level of waste in the chamber has fallen sufficiently to accommodate the new waste, and this is detected by a suitable detector. A second detector may be located upstream of the first detector to enable the flow rate of waste through the processing chamber to be calculated.

21 Claims, 4 Drawing Sheets

CONTROL SYSTEM FOR A WASTE PROCESSING APPARATUS

TECHNICAL FIELD

The present invention relates to an apparatus for the conversion or processing of waste, including the processing, treatment or disposal of waste. In particular, the present invention is directed to a control system and method for controlling the provision of waste to a plasma torch based waste processing apparatus.

BACKGROUND

The processing of waste including municipal waste, medical waste, toxic and radioactive waste by means of plasma-torch based waste processing plants is well known. Referring to FIG. 1, a typical prior art plasma-based processing plant (1) comprises a processing chamber (10) typically in the form of a vertical shaft, in which typically solid, and also mixed (i.e., generally, solid plus liquid and/or semiliquid), waste (20) is introduced at the upper end thereof via a waste inlet means comprising an air lock arrangement (30). One or a plurality of plasma torches (40) at the lower end of the chamber (10) heats the column (35) of waste in the chamber (10), converting the waste into gases that are channeled off via outlet (50), and a liquid material (38) (typically molten metals and/or slag) which is periodically or continuously collected at the lower end of the chamber (10) via reservoir (60). Oxidising fluid, such as air, oxygen or steam (70) may be provided at the lower end of the chamber (10) to convert carbon, produced in the processing of organic waste, into useful gases such as CO and $H_2$, for example. A similar arrangement for dealing with solid waste is described in U.S. Pat. No. 5,143,000, the contents of which are incorporated herein by reference thereto.

Waste cannot be fed into the chamber (10) until the column of waste (35) has descended sufficiently to accommodate the new waste therein. Thus, sufficient time needs to be given for the column to descend: if new waste is added too soon, it is possible that the air lock arrangement (30) may be damaged or may malfunction; if the time delay is too long, the throughput rate and efficiency of the apparatus is lowered.

In JP 10238744, a control system for operating an ash extraction means is described, including the detection of a burning layer at a predetermined height in the furnace. However, there is no disclosure or suggestion on how to automatically control the input of waste into a waste processing apparatus.

It is therefore an aim of the present invention to provide a control system for controlling the input of waste which overcomes the limitations of prior art systems.

It is another aim of the present invention to provide such a system incorporated as an integral part of a plasma-torch based type waste processing apparatus.

It is another aim of the present invention to provide such systems that are relatively simple and thus economic to produce as well as to maintain.

It is another aim of the present invention to provide a method for operating a plasma-based waste processing plant such as to optimize the feeding of waste thereto.

SUMMARY OF INVENTION

The present invention is directed to a control system for controlling the feeding of waste to a waste processing apparatus, the waste processing apparatus having a waste processing chamber adapted for accommodating a column of waste, said apparatus further comprising an air lock system for selectively enabling waste to be fed from an external feeder to a holding chamber comprised in said air lock system, and from said holding chamber to said processing chamber, said control system comprising:

- control means operatively connected to said air lock system;
- at least one first detector operatively connected to said control means and adapted for detecting at least an absence of waste at a first level in said processing chamber and for providing a corresponding first signal to said control means when waste is not detected at said first level;
- wherein said control means is adapted at least to command said air lock system to feed waste from said holding chamber to said processing chamber in response to receiving said first signal.

The said first level is such that a volume of waste that may be accommodated in said processing chamber between said air lock system and said first level is not less than a volume of waste that may be accommodated in said holding chamber.

The control system as may further comprises at least one second detector operatively connected to said control means and adapted for detecting at least an absence of waste at a second level in said processing chamber and for providing a corresponding second signal to said control means when waste is not detected at said second level, wherein said second level is at a predetermined displacement upstream of said first level. Preferably, the first level and said second level are such that a volume of waste that may be accommodated in said processing chamber between said second level and said first level is substantially similar to a volume of waste that may be accommodated in said holding chamber. Preferably, the control means is adapted for determining a flow rate of the waste through said processing chamber based on a second time noted when said second signal is received by said control means and a first time noted when said first signal is received by said control means. The control means is further adapted to control the feeding rate of waste to said external feeder from external sources of waste such as to substantially match the said flow rate of waste through said processing chamber.

The air lock system preferably comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber. The air lock arrangement may be adapted for only permitting one of said first valve and said second valve to be open during operation of said processing chamber.

Preferably, the waste processing apparatus comprises at least one gas outlet means at an upper longitudinal part of the chamber. Further preferably, the waste processing apparatus comprises at least one plasma torch means for generating a hot gas jet at an output end thereof and for directing said jet towards a bottom part of the processing chamber.

The present invention also relates to an apparatus for processing waste comprising:

- a waste processing chamber adapted for accommodating a column of waste, said chamber having an upper end;

at least one primary plasma torch means for generating a hot gas jet at an output end thereof and for directing said jet towards a bottom longitudinal part of the chamber;

at least one liquid product outlet means at a lower longitudinal part of said chamber;

an air lock system for selectively enabling waste to be fed from an external feeder to a holding chamber comprised in said air lock system, and from said holding chamber to said processing chamber, said apparatus further comprising a control system for controlling the feeding of waste to a waste processing apparatus, said control system comprising:

control means operatively connected to said air lock system;

at least one first detector operatively connected to said control means and adapted for detecting at least an absence of waste at a first level in said processing chamber and for providing a corresponding first signal to said control means when waste is not detected at said first level;

wherein said control means is adapted at least to command said air lock system to feed waste from said holding chamber to said processing chamber in response to receiving said first signal.

Typically, the first level is such that a volume of waste that may be accommodated in said processing chamber between said air lock system and said first level is not less than a volume of waste that may be accommodated in said holding chamber.

The apparatus preferably further comprises at least one second detector operatively connected to said control means and adapted for detecting at least an absence of waste at a second level in said processing chamber and for providing a corresponding second signal to said control means when waste is not detected at said second level, wherein said second level is at a predetermined displacement upstream of said first level. Preferably, the first level and said second level are such that a volume of waste that may be accommodated in said processing chamber between said second level and said first level is substantially the same as a volume of waste that may be accommodated in said holding chamber. The control means is preferably further adapted for determining a flow rate of the waste through said processing chamber based on a second time noted when said second signal is received by said control means and a first time noted when said first signal is received by said control means. The control means may be further adapted to control the feeding rate of waste to said external feeder from external sources of waste such as to substantially match the said flow rate of waste through said processing chamber.

Preferably, the air lock system comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber. The air lock arrangement is preferably adapted for only permitting one of said first valve and said second valve to be open during operation of said processing chamber.

The present invention is also directed to a method for controlling the feeding of waste to a waste processing apparatus, wherein said apparatus comprises:

a waste processing chamber adapted for accommodating a column of waste;

an air lock system for selectively enabling waste to be fed from an external feeder to a holding chamber comprised in said air lock system, and from said holding chamber to said processing chamber;

wherein said method comprises:

(a) providing a predetermined amount of waste to said holding chamber;

(b) detecting the absence of waste at a first level in said processing chamber;

(c) providing said waste in (a) to said processing chamber when absence of waste is detected in (b).

In the method, the first level is preferably such that a volume of waste that may be accommodated in said processing chamber between said air lock system and said first level is not less than a volume of waste that may be accommodated in said holding chamber. Preferably, the air lock system comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber, and wherein step (a) comprises the steps:

(a1) opening said first valve;

(a2) providing waste to said holding camber from an external feeder;

(a3) closing said first valve;

wherein said second valve is closed during steps (a1) to (a3).

Preferably, step (c) comprises the steps:

(c1) opening said second valve;

(c2) providing waste from said holding camber to said processing chamber;

(c3) closing said second valve;

wherein said first valve is closed during steps (c1) to (c3).

The method may further comprise the steps:

(d) detecting the absence of waste at a: second level in said processing chamber upstream of said first level;

(e) noting a first time correlated to the detection of absence of waste in step (b);

(f) noting a second time correlated to the detection of absence of waste in step (d);

(g) determining a flow rate for the waste through the processing chamber from the difference between said second time and said first time.

Preferably, the first level and said second level are such that a volume of waste that may be accommodated in said processing chamber between said second level and said first level is substantially the same as a volume of waste that may be accommodated in said holding chamber.

DISCLOSURE OF INVENTION

The present invention is defined by the claims, the contents of which are to be read as included within the disclosure of the specification, and will now be described by way of example with reference to the accompanying Figures.

The present invention relates to a system for, controlling the feeding of waste to a waste converting apparatus. The term "waste converting apparatus" herein includes any apparatus adapted for treating, processing, converting or disposing of any waste materials, including municipal waste, household waste, industrial waste, medical waste, radioactive waste and other types of waste. The present invention is also directed to such waste converting apparatus having the aforesaid system, and to methods of operating such systems and apparatuses.

The relative positional terms "upstream" and "downstream" herein refer to directions generally away from and along the direction of flow, respectively, of the waste, unless otherwise specified.

Figure 1:
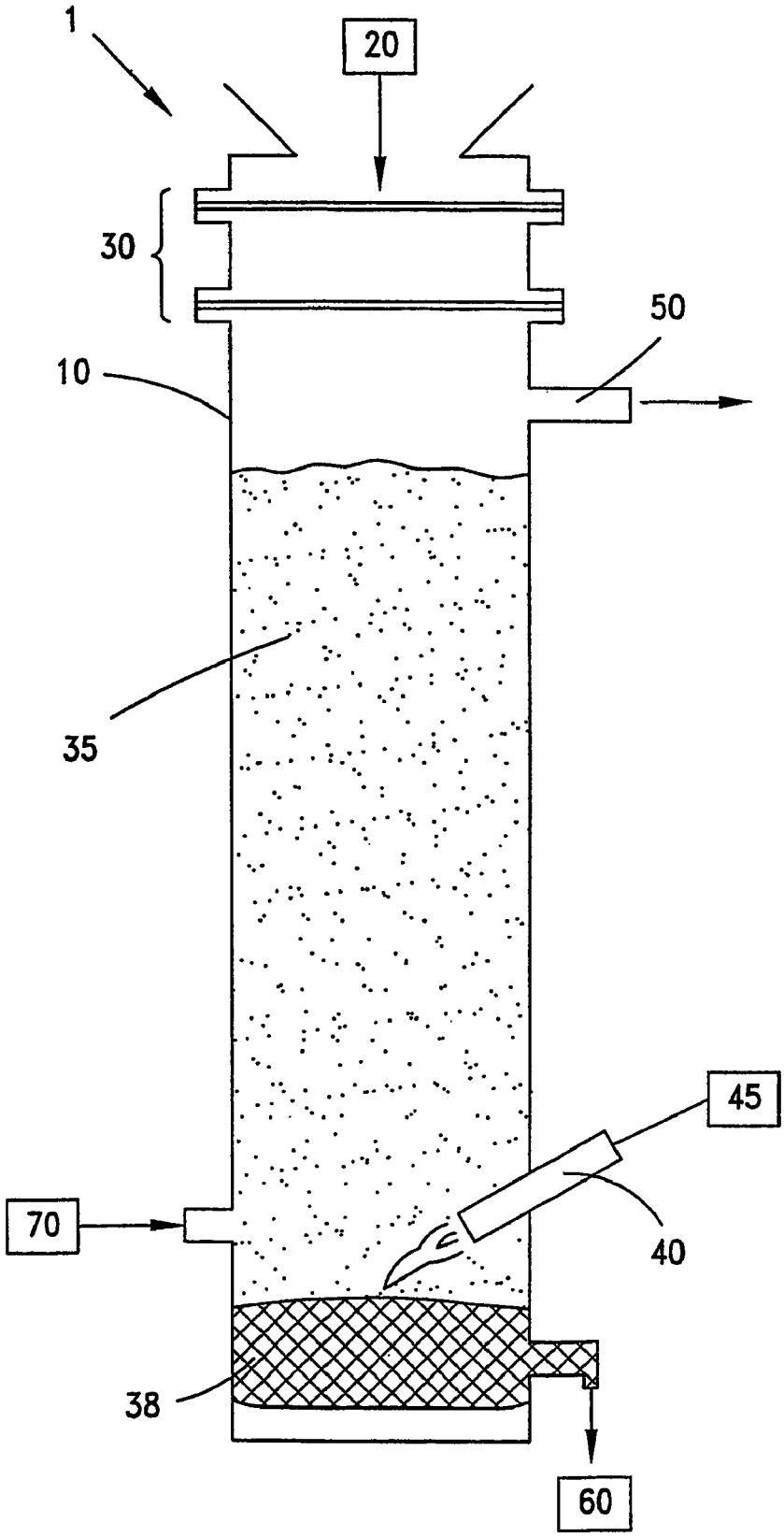
Fig. 1 PRIOR ART
FIG. 1 shows schematically the general layout and main elements of a typical solid/mixed waste plasma processing apparatus of the prior art.
Figure 2:
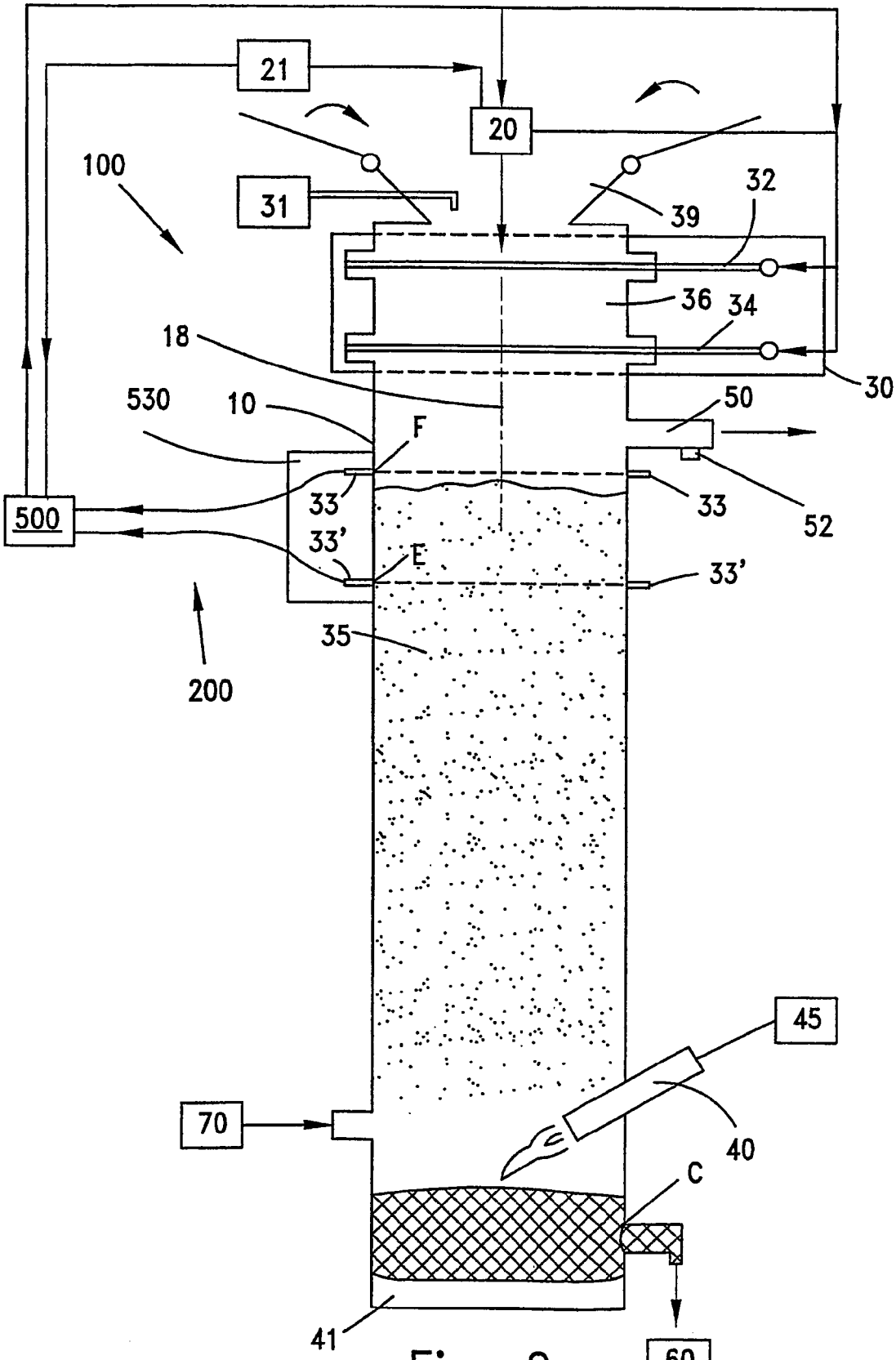
FIG. 2 shows schematically the main elements of the preferred embodiment of the present invention in relation to a typical plasma processing apparatus.

Referring to the Figures, FIG. 2 illustrates a preferred embodiment of the present invention. The plasma waste processing apparatus, designated by the numeral (100), comprises a processing chamber (10), which while typically is in the form of a cylindrical or frusto-conical vertical shaft, may be in any desired shape. Typically, a solid or mixed waste external feeding system (20) introduces typically solid waste at the upper end of the chamber (10) via a waste inlet means comprising an air lock arrangement (30). Mixed waste may also be fed into the chamber (10), though generally gaseous and liquid waste is removed from the apparatus (10) without substantial treatment. The solid/mixed waste feeding system (20) may comprise any suitable conveyor means or the like, and may further comprise a shredder for breaking up the waste into smaller pieces.

The processing chamber (10) is typically, but not necessarily, in the form of a cylindrical shaft having a substantially vertical longitudinal axis (18). The inner part of processing chamber (10) in contact with the waste column (35) is typically made from suitable refractory material, and has a bottom end comprising a liquid product collection zone (41), typically in the form of a crucible, having at least one outlet associated with one or more collection reservoirs (60). The processing chamber (10) further comprises at the upper end thereof at least one primary gas outlet (50) for collecting primarily product gases from the processing of waste. A metal jacket typically surrounds the outside of the chamber (10).

The air lock arrangement (30) may comprise an upstream first valve (32) and a downstream second valve (34) defining a loading chamber (36) therebetween. While the first valve (32) and the second valve (84) are illustrated in FIG. 2 as being in vertically displaced arrangement, the valves may be in any other suitable arrangement. For example the valves (32), (34) may be in horizontally displaced arrangement across a horizontal conduit having an elbow passage or the like to the upper part of the chamber (10). The valves (32), (34) are preferably gate valves operated electrically, pneumatically or hydraulically to open and close independently as required. A closeable hop arrangement (39) funnels typically solid and/or mixed waste from the feeding system (20) into the loading chamber (36) when the first valve (32) is open, and the second valve (34) is in the closed position. Optionally, the air lock arrangement (30) may comprise additional valves.

Optionally, the hop arrangement (39) may comprise a disinfectant spraying system (31) for periodically or continuously spraying the same with disinfectant, as required, particularly when medical waste is being processed by apparatus (100).

One or a plurality of primary plasma torches (40) at the lower end of the processing chamber (10) are operatively connected to suitable electric power, gas and water coolant sources (45), and the plasma torches (40) may be of the transfer or non-transfer types. The torches (40) are mounted in the chamber (10) by means of suitably sealed sleeves, which facilitates replacing or servicing of the torches (40). The torches (40) generate hot gases that are directed downwardly at an angle into the bottom end of the column of waste. The torches (40) are distributed at the bottom end of the chamber (10) such that in operation, the plumes from the torches (40) heat the bottom of the column of waste, as homogeneously as possible, to a high temperature, typically in the order of about 1600° C. or more. The torches (40) generate at their downstream output ends hot gas jets, or plasma plumes, having an average temperature of about 2000° C. to about 7000° C. The heat emanating from the torches (40) ascends through the column of waste, and thus a temperature gradient is set up in the processing chamber (10). Hot gases generated by the plasma torches (40) support the temperature level in the chamber (10) which is sufficient for continuously converting the waste into product gases that are channeled off via outlet (50), and into a liquid material (38) that may include molten metal and/or slag, which may be periodically or continuously collected at the lower end of the chamber (10) via one or more reservoirs (60).

Oxidising fluid (70), such as air, oxygen or steam may be provided at the lower end of the chamber (10) to convert carbon, produced in the processing of organic waste, into useful gases such as CO and $H_2$, for example.

The apparatus (100) may further comprise a scrubber system (not shown) operatively connected to the outlet (50), for processing product gases and for removing particulate matter and/or other liquid droplets (including pitch), as well as any undesired gases (such as HCl, $H_2S$, HF, for example) from the product gas stream leaving the chamber (10) via outlet (50). Particulate matter may include organic and inorganic components. Pitch may be contained in the gas stream leaving outlet (50) in gas or liquid form. Scrubbers capable of performing such tasks are well known in the art and do not require to be further elaborated upon herein. The scrubber is typically operatively connected downstream thereof to a suitable gas processing means (not shown) such as a gas turbine power plant or a manufacturing plant, for example, for economically utilising the cleaned product gases, typically comprising at this stage $H_2$, CO, $CH_4$, $CO_2$ and $N_2$. The scrubber may further comprise a reservoir (not shown) for collecting particulate matter, pitch and liquid matter removed form the gas products by the scrubber. Such particulate matter and liquid matter (including pitch) require further processing.

Optionally, the apparatus (100) may further comprise an afterburner (not shown) operatively connected to the outlet (50) for burning organic components in the product gases and connected to suitable afterburner energy utilisation systems and also to off-gas cleaning systems (not shown). Such energy utilisation systems may include a boiler and steam turbine arrangement coupled to an electric generator. Off-gas cleaning systems may produce solid waste materials such as fly ash with reagents, and/or liquid solutions comprising waste materials which require further processing.

According to the present invention, and referring particularly to FIG. 2, a waste feed control system (200) is provided for the feeding of waste into the chamber (10), thereby leading to a more efficient, smoother and continuous operation of the plasma waste processing apparatus (100). While such control may be substantially automatic, it may also be semi-automatic or manual.

According to the invention, feeding of waste into the loading chamber (36) typically continues until the level of waste in the loading chamber (36) reaches a predetermined point below full capacity, to minimise the possibility of any waste interfering with closure of the first valve (32). The first valve (32) is then closed. In the closed position, each of the valves (32), (34) provides an air seal. When required, the second valve (34) is then opened enabling the waste in the holding chamber (36) to be fed into the processing chamber (10) with relatively little or no air being drawn therewith.

Thus, referring to FIG. 2, in the preferred embodiment of the present invention, the control system (200) comprises a suitable controller (500) operatively connected to feeding system (20), to said air lock arrangement (30), and to a waste level detection system (530), The controller (500) may comprise a human controller and/or, preferably, a suitable computer system operatively connected thereto and to other components of the apparatus (100).

The waste level detection system (530) typically comprises one or more suitable sensors or detectors (33') at an upper part or level (E) of the chamber (10) for detecting when the level of waste reaches or rather passes this level. Preferably, the waste level detection system (530) further comprises one or more suitable sensors or detectors (33) at a level (F), displaced upstream with respect to level (E) of the chamber (10), for detecting when the level of waste reaches or rather passes this level. Level (F) may advantageously represent the maximum safety limit for amount of waste in the chamber (10), while level (E) may represent a level of waste within the chamber (10) at which it is efficient to provide more waste to the chamber (10). Thus, the volume in the chamber (10) between level (E) and level (F) may be approximately equal to the volume of waste that may be accommodated in loading chamber (36). Typically, whenever the level of waste reaches level (E), a suitable signal may be sent by detector (33') to the controller (500), advising that a new batch of waste may be fed into the chamber (10).

Additionally, the detectors (33) and (33') at levels (F) and (E) may also provide suitable datums for determining an actual flow rate of the waste through the chamber (10) by measuring the time interval between the time when the level of waste is at level (F) to when it reaches level (E), for example. This provides information which may be advantageous in determining the rate at which waste needs to be provided to the feeder (20) itself.

According to the present invention, the controller (500) is also be operatively connected to the air lock arrangement (30), in particular to the valves (32), (34) to coordinate loading of the loading chamber (36) from the feeding system (20), and unloading of the waste from the loading chamber (36) to the processing chamber (10).

According to the present invention, the processing chamber (10) is typically filled with waste material up to a predetermined first level via the airlock arrangement (30), typically up to about the level of the primary gas outlet (50) or below thereto. Waste level detection system (530) senses when the level of waste drops sufficiently from the predetermined first level (as a result of processing in the chamber (10)) and sends a suitable signal to so advise controller (500), and thus to enable another batch of waste to be fed to the processing chamber (10) via the loading chamber (36). The controller (500) then closes second valve (34) and opens first valve (32) to enable the loading chamber (36) to be re-loaded via feeding system (20), and then closes first valve (32), ready for the next feeding cycle.

Figure 3:
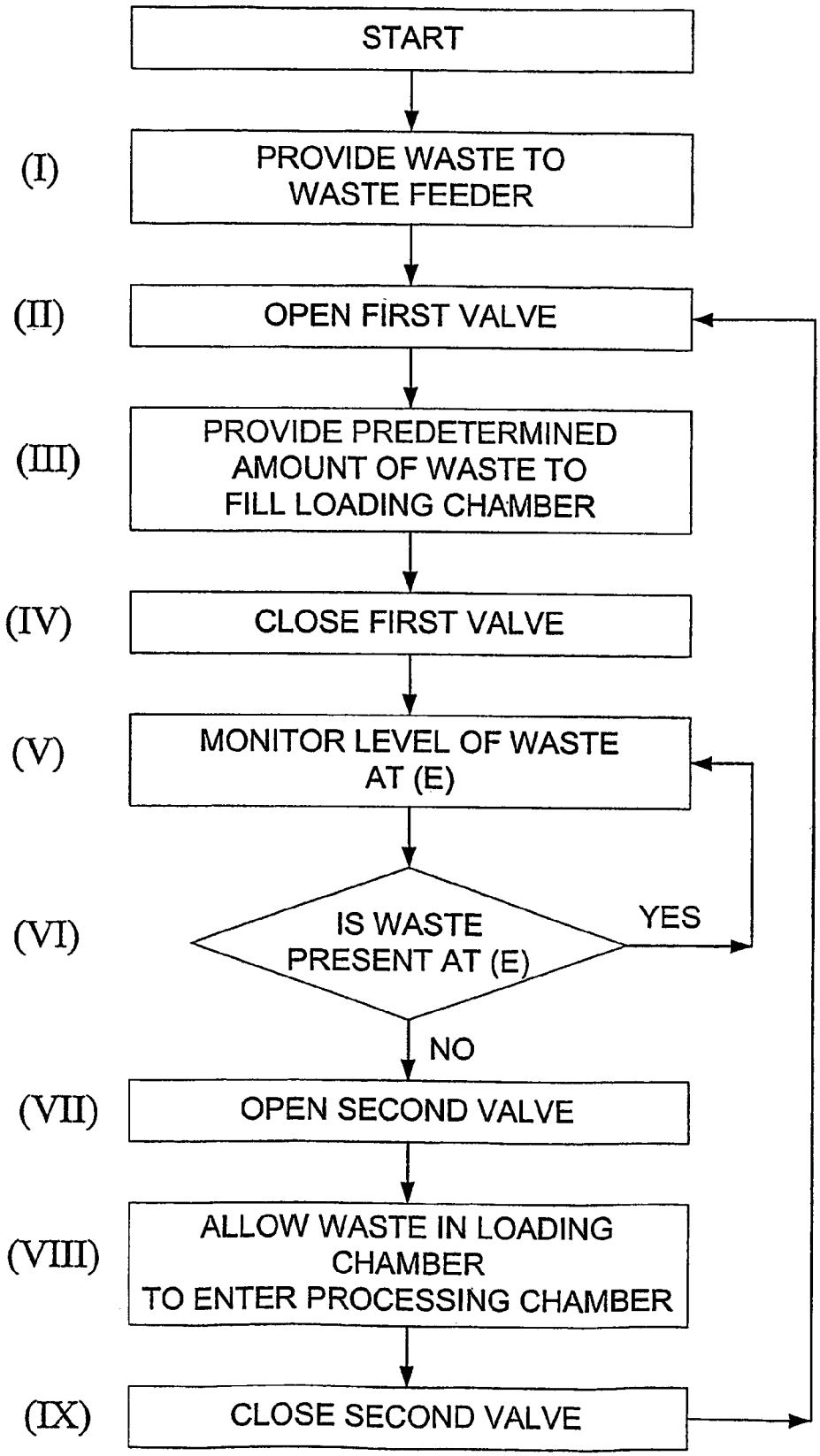
FIG. 3 shows a schematic flow chart illustrating an operating procedure for the system of FIG. 2.

Thus, referring to FIG. 3, the waste control system according to the preferred embodiment may be operated as follows.

In step (I), waste is provided to the feeding system (20) from external waste sources. When the loading chamber (36) is empty, after having discharged its contents to the processing chamber (10), the first valve (32) is opened (step (II)), the waste feeder feeds a predetermined amount of waste into the loading chamber (36), correlated to the size of the loading chamber (36) (step (II)), and then the first valve (32) is closed (step (IV)). The loading chamber (36) is now ready for providing waste to the processing chamber (10).

In step (V), the level of waste at (E) is monitored by the detectors (33'). Monitoring may be continuous or periodic, at a suitable sampling rate which is significantly less than the rate at which waste is processed in the chamber. If there is waste at level (E), then the detectors (33') simply keep on monitoring. As soon as it detected by the detectors (33') that the waste has descended below the level (E), i.e., when the detectors (33') detect an absence of waste at level (E), a signal is sent to the control means (500) to open the second valve (34) (step (VII)), whereupon the waste in the holding chamber (36) is fed to the processing chamber (10) (step (VIII)). The second valve (34) is then closed on receiving the appropriate signal from the controller (500) (step (IX)), and a new feed cycle begins with step (II).

Figure 4:
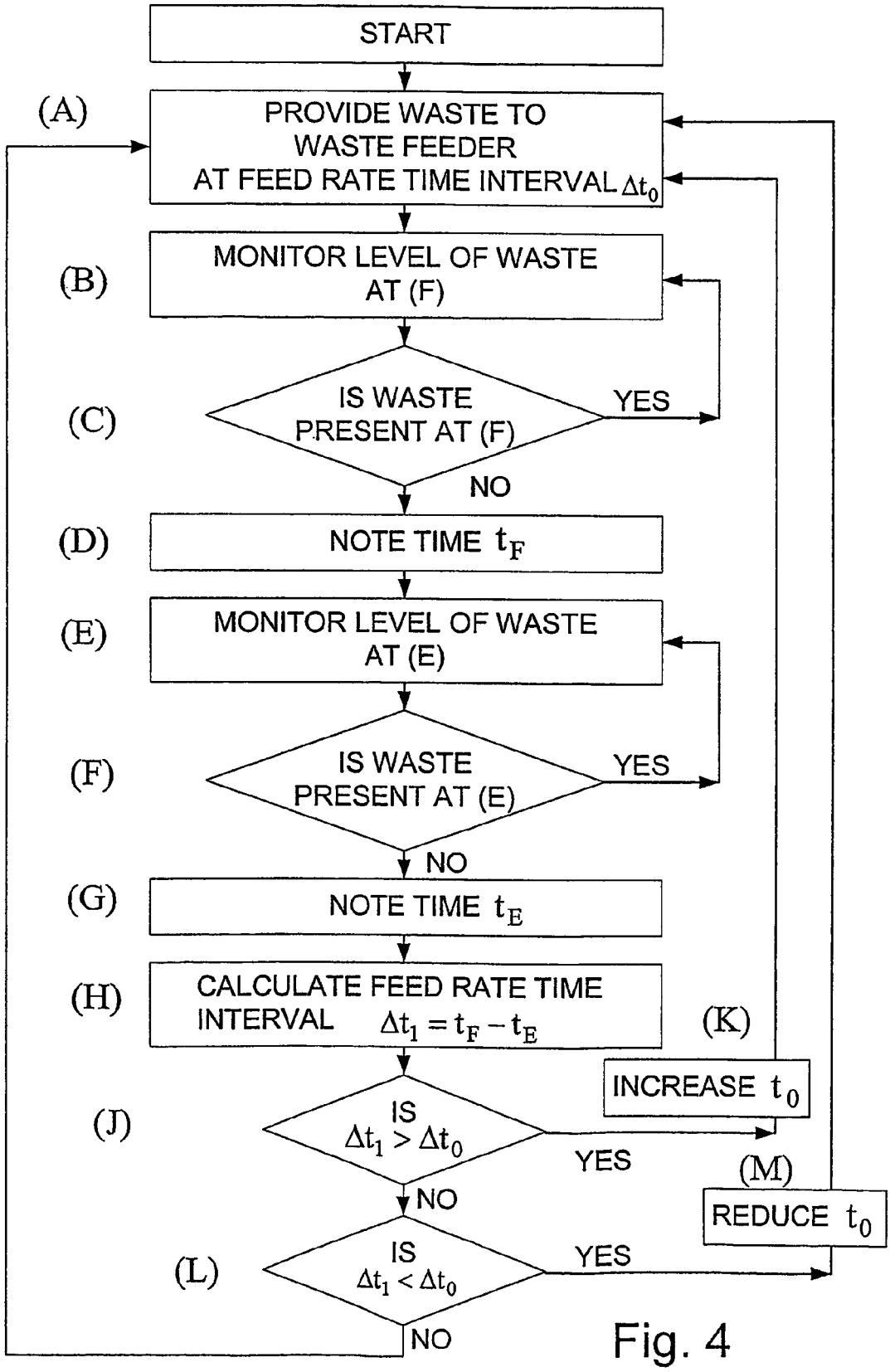
FIG. 4 shows a schematic flow chart illustrating an optional operating procedure for the system of FIG. 2.

The rate at which waste is fed to the feeder (20) in step (I) may also be usefully controlled as follows. Referring to FIG. 4, in step (A), the feeder (20) is provided with waste at a feed rate correlated to a time interval $\Delta t_0$, in other words, at a feed rate equivalent to:

(amount of waste that may be accommodated in the holding chamber (36))/(time $\Delta t_0$).

In step (B), the level of waste at (F) is monitored by the detectors (33). Monitoring may be continuous or periodic, typically at a suitable sampling rate which is significantly less than the rate at which waste is processed in the chamber (10). If there is waste at level (F), then the detectors (33) simply keep on monitoring. As soon as it detected by the detectors (33) that the waste has descended below the level (F), i.e., when the detectors (33) detect an absence of waste at level (F), a datum time $t_F$ is noted a by controller (500) (step (D)). Concurrently or subsequently, in step (E) the level of waste at (E) is monitored by the detectors (33'). Monitoring may be continuous or periodic, typically at a suitable sampling rate which is significantly less than the rate at which waste is processed in the chamber (10). If there is waste at level (E), then the detectors (33') simply keep on monitoring. As soon as it detected by the detectors (33') that the waste has descended below the level (E), i.e., when the detectors (33') detect an absence of waste at level (E), a datum time $t_E$ is noted by controller (500) (step (G)). The controller (500) then calculates in step (H) the time interval $\Delta t_1 = t_E - t_F$. If the rate at which waste is being processed in the chamber (10), i.e. $\Delta t_1$, is greater than the rate at which waste is being provided to the feeder (20), i.e., $\Delta t_0$ then the latter rate may be increased (steps (J), (K)). On the other hand, if the rate at which waste is being processed in the chamber (10), i.e. $\Delta t_1$ is lower than the rate at which waste is being provided to the feeder (20), i.e., $\Delta t_0$ then the latter rate may be reduced (steps (L), (M)).

While the waste feed control system according to the present invention is best incorporated as an integral part of a plasma-type mixed waste converter, it is clear that the system of the present invention is readily retrofittable, on any one of a large number of plasma-based waste converters of the art.

While in the foregoing description describes in detail only a few specific embodiments of the invention, it will be understood by those skilled in the art that the invention is not limited thereto and that other variations in form and details may be possible without departing from the scope and spirit of the invention herein disclosed.

The invention claimed is:

1. An apparatus for processing waste comprising: a control system for controlling the feeding of waste to said waste processing apparatus, a waste processing chamber adapted for accommodating a column of waste, said apparatus further comprising an air lock system for selectively enabling waste to be fed from an external feeder to a holding chamber comprised in said air lock system, and from said holding chamber to said processing chamber, said control system comprising:

control means operatively connected to said air lock system;

at least one first detector operatively connected to said control means and adapted for detecting at least an absence of waste at a first level in said processing chamber and for providing a corresponding first signal to said control means when waste is not detected at said first level;

wherein said control means is adapted at least to command said air lock system to feed waste from said holding chamber to said processing chamber in response to receiving said first signal;

characterized in that said first level is such that the volume of said processing chamber between said air lock system and said first level is not less than the volume of waste that may be accommodated in said holding chamber.

2. An apparatus as claimed in claim 1, further comprising at least one second detector operatively connected to said control means and adapted for detecting at least an absence of waste at a second level in said processing chamber and for providing a corresponding second signal to said control means when waste is not detected at said second level;

wherein said second level is at a predetermined displacement upstream of said first level.

3. An apparatus as claimed in claim 2, wherein said first level and said second level are such that a volume of waste that may be accommodated in said processing chamber between said second level and said first level is substantially similar to a volume of waste that may be accommodated in said holding chamber.

4. An apparatus as claimed in claim 3, wherein said control means is adapted for determining a flow rate of the waste through said processing chamber based on a second time noted when said second signal is received by said control means and a first time noted when said first signal is received by said control means.

5. An apparatus as claimed in claim 4, wherein said control means is further adapted to control the feeding rate of waste to said external feeder from external sources of waste such as to substantially match the said flow rate of waste through said processing chamber.

6. An apparatus as claimed in claim 1, wherein said air lock system comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber.

7. An apparatus as claimed in claim 6, wherein said air lock arrangement is adapted for only permitting one of said first valve and said second valve to be open during operation of said processing chamber.

8. An apparatus as claimed in claim 1, wherein said waste processing apparatus comprises at least one gas outlet means at an upper longitudinal part of the chamber.

9. An apparatus as claimed in claim 1, wherein said waste processing apparatus comprises at least one plasma torch means for generating a hot gas jet at an output end thereof and for directing said jet towards a bottom part of the processing chamber.

10. Apparatus for processing waste comprising:

(a) a waste processing chamber adapted for accommodating a column of waste, said chamber having an upper end;

(b) at least one plasma torch means for generating a hot gas jet at an output end thereof and for directing said jet towards a bottom longitudinal part of said chamber;

(c) at least one liquid product outlet means at a lower longitudinal part of said chamber;

(d) an air lock system for selectively enabling waste to be fed from an external feeder to a holding chamber comprised in said air lock system, and from said holding chamber to said processing chamber, said apparatus further comprising a control system for controlling the feeding of waste to a waste processing apparatus, said control system comprising:

control means operatively connected to said air lock system;

at least one first detector operatively connected to said control means and adapted for detecting at least an absence of waste at a first level in said processing chamber and for providing a corresponding first signal to said control means when waste is not detected at said first level;

wherein said control means is adapted at least to command said air lock system to feed waste from said holding chamber to said processing chamber in response to receiving said first signal;

characterized in that said first level is such that a volume of waste that may be accommodated in said processing chamber between said air lock system and said first level is not less than a volume of waste that may be accommodated in said holding chamber.

11. Apparatus as claimed in claim 10, further comprising at least one second detector operatively connected to said control means and adapted for detecting at least an absence of waste at a second level in said processing chamber and for providing a corresponding second signal to said control means when waste is not detected at said second level;

wherein said second level is at a predetermined displacement upstream of said first level.

12. Apparatus as claimed in claim 11, wherein said first level and said second level are such that a volume of waste that may be accommodated in said processing chamber between said second level and said first level is substantially the same as a volume of waste that may be accommodated in said holding chamber.

13. Apparatus as claimed in claim 12, wherein said control means is adapted for determining a flow rate of the waste through said processing chamber based on a second time noted when said second signal is received by said control means and a first time noted when said first signal is received by said control means.

14. Apparatus as claimed in claim 13, wherein said control means is further adapted to control the feeding rate of waste to said external feeder from external sources of waste such as to substantially match the said flow rate of waste through said processing chamber.

15. Apparatus as claimed in claim 10, wherein said air lock system comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber.

16. Apparatus as claimed in claim 15, wherein said air lock arrangement is adapted for only permitting one of said first valve and said second valve to be open during operation of said processing chamber.

17. A method for controlling the feeding of waste to a waste processing apparatus, wherein said apparatus comprises:

a waste processing chamber adapted for accommodating a column of waste;

an air lock system for selectively enabling waste to be fed from an external feeder to a holding chamber comprised in said air lock system, and from said holding chamber to said processing chamber;

wherein said method comprises:

(a) providing a predetermined amount of waste to said holding chamber;

(b) detecting the absence of waste at a first level in said processing chamber;

(c) providing said waste in (a) to said processing chamber when absence of waste is detected in (b);

characterized in that said first level is such that a volume of waste that may be accommodated in said processing chamber between said air lock system and said first level is not less than a volume of waste that may be accommodated in said holding chamber.

18. A method as claimed in claim 17, wherein said air lock system comprises at least a first valve and a second valve defining said holding chamber therebetween, wherein said first valve is selectively openable and closeable to enable and prevent, respectively, provision of waste to said holding chamber, and wherein said second valve is selectively openable and closeable to enable and prevent, respectively, the provision of waste from said holding chamber to said processing chamber, and wherein step (a) comprises the steps:

(a1) opening said first valve;

(a2) providing waste to said holding camber from an external feeder;

(a3) closing said first valve;

wherein said second valve is closed during steps (a1) to (a3).

19. A method as claimed in claim 17, wherein step (c) comprises the steps:

(c1) opening said second valve;

(c2) providing waste from said holding camber to said processing chamber;

(c3) closing said second valve;

wherein said first valve is closed during steps (c1) to (c3).

20. A method as claimed in claim 17, further comprising the steps:

(d) detecting the absence of waste at a second level in said processing chamber upstream of said first level;

(e) noting a first time correlated to the detection of absence of waste in step (b);

(f) noting a second time correlated to the detection of absence of waste in step (d);

(g) determining a flow rate for the waste through the processing chamber based on the difference between said second time and said first time.

21. A method as claimed in claim 19, wherein said first level and said second level are such that a volume of waste that may be accommodated in said processing chamber between said second level and said first level is substantially the same as a volume of waste that may be accommodated in said holding chamber.

* * * * *